US008820567B2

(12) United States Patent
Cutler

(10) Patent No.: US 8,820,567 B2
(45) Date of Patent: Sep. 2, 2014

(54) TALKING TRASH RECEPTACLE

(76) Inventor: Don Cutler, Bakersfield, CA (US)

( * ) Notice: Subject to any disclaimer, the term of this patent is extended or adjusted under 35 U.S.C. 154(b) by 338 days.

(21) Appl. No.: 13/425,781

(22) Filed: Mar. 21, 2012

(65) Prior Publication Data

US 2013/0248389 A1 Sep. 26, 2013

(51) Int. Cl.
*B65D 25/14* (2006.01)

(52) U.S. Cl.
USPC ..... 220/495.06; 220/908

(58) Field of Classification Search
USPC ..... 137/551, 558, 560; 206/216, 366, 370; 209/1; 220/495.01, 495.06, 908, 908.1; 232/44; 241/100
See application file for complete search history.

(56) References Cited

U.S. PATENT DOCUMENTS 6,076,694 A * 6/2000 Ragot ..... 220/908
7,033,039 B2 * 4/2006 Lin ..... 220/908
8,157,159 B2 * 4/2012 Al-Hadhoud et al. ..... 220/908
2009/0119113 A1 * 5/2009 Dancy ..... 220/495.01
2009/0218352 A1 * 9/2009 Sued et al. ..... 220/495.06
2009/0314169 A1 * 12/2009 Kachkovsky ..... 100/229 A
2011/0056952 A1 * 3/2011 Borowski et al. ..... 220/495.06
2011/0155746 A1 * 6/2011 Armen ..... 220/662
2012/0037637 A1 * 2/2012 Beyda et al. ..... 220/495.06
2013/0042919 A1 * 2/2013 Lambke ..... 137/1

* cited by examiner

*Primary Examiner* — Luan K Bui

(57) ABSTRACT

The present invention is a talking trash receptacle that includes a lid that is removably placed on the receptacle, a plurality of speakers that are disposed on the lid that emit an audio message alerting one or more users that the receptacle is full, a beam sensor that runs across the receptacle and senses when trash and debris contained and piled-up in the receptacle intersect the beam sensor and a trash bag that is disposed within the receptacle that contains the trash and debris that are contained and piled-up within the receptacle. The receptacle also includes a trash can that contains the trash bag and the trash and debris, a speaker board that serves as a base of the speakers that are disposed on the speaker board and a plurality of sensor holding arms that secures the beam sensor in place that runs across the top portion of the receptacle.

20 Claims, 3 Drawing Sheets

TALKING TRASH RECEPTACLE

TECHNICAL FIELD & BACKGROUND

Each day individuals either pass by or willingly ignore full trash cans in order to avoid the chore of taking out the trash. When trash cans become full or exceed the rim with waste, the smell can often overpower a room or even a home.

The present invention generally relates to a trash receptacle. More specifically, the invention is a talking trash receptacle.

It is an object of the invention to provide a talking trash receptacle that has a built-in sensor that senses when the trash receptacle is full and activates an audio message.

It is an object of the invention to provide a talking trash receptacle that monitors and notifies a user when a trash receptacle is full.

It is an object of the invention to provide a talking trash receptacle that teaches children users and adults an entertaining way to indicate when a trash receptacle is full.

What is really needed is a talking trash receptacle that has a built-in sensor that senses when the trash receptacle is full and activates an audio message that monitors and notifies a user when a trash receptacle is full that teaches children users and adults an entertaining way to indicate when a trash receptacle is full.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

Figure 1A:
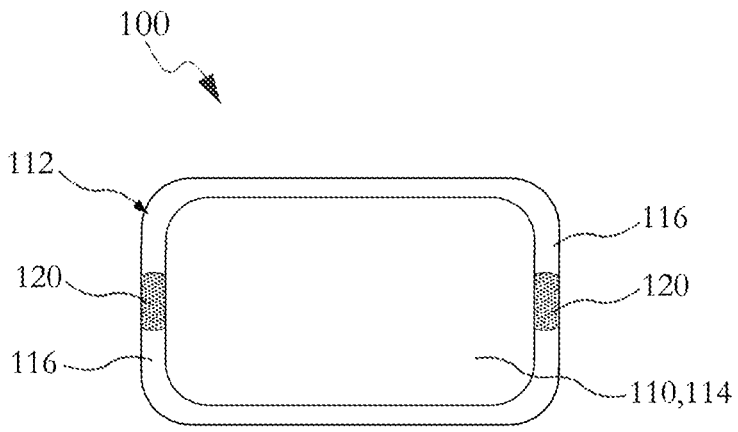
FIG. 1A illustrates a top view of a talking trash receptacle, according to an embodiment of the present invention.

FIG. 1A illustrates a top view of a talking trash receptacle 100, according to an embodiment of the present invention. The talking trash receptacle 100 includes a lid 110 and a plurality of speakers 120. The lid 110 has a top perimeter 112, is generally rectangular-shaped 114 and is removably placed on a top portion (FIG. 1B, 102) of the talking trash receptacle 100. The speakers 120 are disposed on the top perimeter 112 of the lid 110 and are illustrated in FIG. 1A disposed on opposite end sides 116 of the top perimeter 112. The speakers 120 can be any suitable quantity of speakers 120 positioned and disposed on any suitable location on the lid 110. The speakers 120 emit an audio message alerting one or more users that the talking trash receptacle 100 is full. The one or more users may choose between a set of pre-programmed audio recordings and may even record their own personal messages in order to enhance the entertainment value of the talking trash receptacle 100.

Figure 1B:
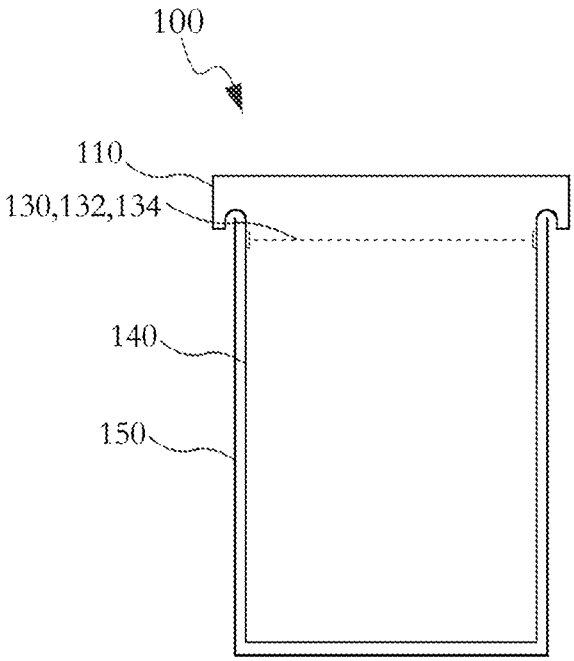
FIG. 1B illustrates a side view of a talking trash receptacle, according to an embodiment of the present invention.

FIG. 1B illustrates a side view of a talking trash receptacle 100, according to an embodiment of the present invention. The talking trash receptacle 100 has similar features described and illustrated in FIG. 1A such as a lid 110 and a plurality of speakers 120. The talking trash receptacle 100 also includes a beam sensor 130, a trash bag 140 and a trash can 150. The beam sensor 130 runs across a top portion 132 of the talking trash receptacle 100 just below the lid 110 and senses when trash and debris contained and piled-up in the talking trash receptacle 100 intersect the beam sensor 130. The beam sensor 130 can be an electron beam 132, a UV beam 134 or any other suitable beam that can sense when the trash and debris are contained and piled-up at the beam sensor 130 level of the talking trash receptacle 100. The trash bag 140 is disposed within the talking trash receptacle 100 and contains the trash and debris that are contained and piled-up within the talking trash receptacle 100. The trash bag 140 can be any suitable sized trash bag made of any suitable material such as plastic or paper. The trash can 150 is a feature of the talking trash receptacle 100 that contains the trash bag 140 and the trash and debris that are contained and piled-up within the trash bag 140. The trash can 150 can be any suitable sized trash can made of any suitable material such as plastic, rubber or metal.

Figure 1C:
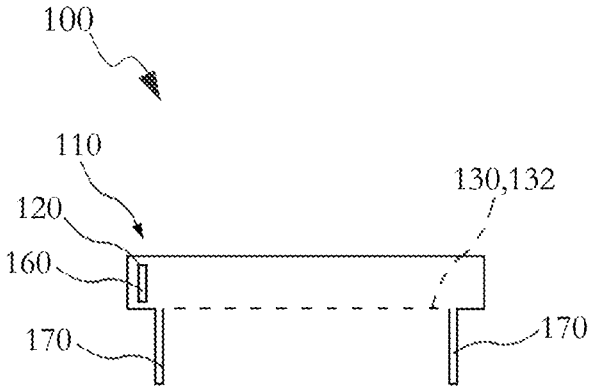
FIG. 1C illustrates a side view of a lid of a talking trash receptacle, according to an embodiment of the present invention.

FIG. 1C illustrates a side view of a lid of a talking trash receptacle 100, according to an embodiment of the present invention. The talking trash receptacle 100 has similar features described and illustrated in FIGS. 1A and 1B such as a lid 110, a plurality of speakers 120, a beam sensor 130, a trash bag 140 and a trash can 150. The talking trash receptacle 100 additionally includes a speaker board 160 and a plurality of sensor holding arms 170. The speaker board 160 serves as a base of the speakers 120 described and illustrated in FIG. 1A that are disposed on the speaker board 160. The sensor holding arms 170 secure the beam sensor 130 in place that runs across a top portion 132 of the talking trash receptacle 100.

Comprised of a trash receptacle capable of detecting when trash in the receptacle needs to be removed, as well as notifying those in the immediate area, the talking trash receptacle is a suitable alternative to similar current products. The talking trash receptacle contains a built-in sensor which is able to identify when trash in a trash receptacle is full and utilizes the afforded speaker to emit an audio message alerting the user. Individuals may choose between a set of pre-programmed audio recordings and may even record their own personal messages in order to enhance the entertainment value of the talking trash receptacle. Able to teach accountability, responsibility and honesty, the talking trash receptacle may be readily available at retail and department stores. The talking trash receptacle features a trash receptacle capable of detecting and alerting users when the trash needs to be taken out and can be powered by hardwire electrically or through one or more batteries. The talking trash receptacle is designed to also be available as a clip-on that can be attached to an existing trash can.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A talking trash receptacle with a top portion, comprising:

a lid that has a top perimeter and is removably placed on said top portion of said talking trash receptacle;

a plurality of speakers that are disposed on said top perimeter of said lid that emit an audio message alerting one or more users that said talking trash receptacle is full;

a beam sensor that runs across said top portion of said talking trash receptacle just below said lid and senses when trash and debris contained and piled-up in said talking trash receptacle intersect said beam sensor;

a trash bag that is disposed within the talking trash receptacle and contains said trash and debris that are contained and piled-up within said talking trash receptacle;

a trash can that contains said trash bag and said trash and debris that are contained and piled-up within said trash bag;

a speaker board that serves as a base of said speakers that are disposed on said speaker board; and a plurality of sensor holding arms that secures said beam sensor in place that runs across said top portion of said talking trash receptacle.

2. The talking trash receptacle according to claim 1, wherein said speakers are disposed on opposite end sides of said top perimeter.

3. The talking trash receptacle according to claim 1, wherein said speakers emit a set of pre-programmed audio recordings from one or more users.

4. The talking trash receptacle according to claim 3, wherein said one or more users select a plurality of personal messages recorded that are emitted from said speakers.

5. The talking trash receptacle according to claim 1, wherein said beam sensor is an electron beam.

6. The talking trash receptacle according to claim 1, wherein said trash bag is made of plastic.

7. The talking trash receptacle according to claim 1, wherein said trash bag is made of paper.

8. The talking trash receptacle according to claim 1, wherein said trash can is made of plastic.

9. The talking trash receptacle according to claim 1, wherein said trash can is made of rubber.

10. The talking trash receptacle according to claim 1, wherein said trash can is made of metal.

11. A talking trash receptacle with a top portion, comprising:

a lid that has a top perimeter and is removably placed on said top portion of said talking trash receptacle;

a plurality of speakers that are disposed on said top perimeter of said lid that emit an audio message alerting one or more users that said talking trash receptacle is full, wherein said speakers are disposed on opposite end sides of said top perimeter and said speakers emit a set of pre-programmed audio recordings from one or more users;

a beam sensor that runs across said top portion of said talking trash receptacle just below said lid and senses when trash and debris contained and piled-up in said talking trash receptacle intersect said beam sensor;

a trash bag that is disposed within the talking trash receptacle and contains said trash and debris that are contained and piled-up within said talking trash receptacle;

a trash can that contains said trash bag and said trash and debris that are contained and piled-up within said trash bag;

a speaker board that serves as a base of said speakers that are disposed on said speaker board; and a plurality of sensor holding arms that secures said beam sensor in place that runs across said top portion of said talking trash receptacle.

12. The talking trash receptacle according to claim 11, wherein said lid is generally rectangular-shaped.

13. The talking trash receptacle according to claim 11, wherein said one or more users select a plurality of personal messages recorded that are emitted from said speakers.

14. The talking trash receptacle according to claim 11, wherein said beam sensor is an electron beam.

15. The talking trash receptacle according to claim 11, wherein said beam sensor is a UV beam.

16. The talking trash receptacle according to claim 11, wherein said trash bag is made of plastic.

17. The talking trash receptacle according to claim 11, wherein said trash bag is made of paper.

18. The talking trash receptacle according to claim 11, wherein said trash can is made of plastic.

19. The talking trash receptacle according to claim 11, wherein said trash can is made of rubber.

20. The talking trash receptacle according to claim 11, wherein said trash can is made of metal.

* * * * *